United States Patent [19]

Chattin

[11] Patent Number: 4,834,061

[45] Date of Patent: May 30, 1989

[54] CABLE VIBRAGUARD

[75] Inventor: Jesse Chattin, Tampa, Fla.

[73] Assignee: Chattin Binder Bows, Inc., Tampa, Fla.

[21] Appl. No.: 189,367

[22] Filed: May 2, 1988

[51] Int. Cl.[4] ..... F41B 5/00

[52] U.S. Cl. ..... 124/86; 124/88

[58] Field of Search ..... 124/23 R, 24 R, 86, 124/88, 90, 92, DIG. 1

[56] References Cited

U.S. PATENT DOCUMENTS

| | | | |
|---|---|---|---|
| 4,332,231 | 6/1982 | Napier et al. | 124/24 R |
| 4,377,152 | 3/1983 | Saunders | 124/88 |
| 4,452,222 | 6/1984 | Quartino et al. | 124/24 R |
| 4,478,203 | 10/1984 | Hayes | 124/24 R |
| 4,542,732 | 9/1985 | Troncoso | 124/24 R |
| 4,572,153 | 2/1986 | MacPherson | 124/88 |
| 4,596,228 | 6/1986 | Smith | 124/23 R |

*Primary Examiner*—Randolph A. Reese
*Assistant Examiner*—John Ricci

[57] ABSTRACT

A cable guard for use with a compound bow having a handle portion, a pair of bow limbs together with a first cable, a second cable and a bowstring comprises a rod with a first end and a second end. A mounting device attaches in use the first end of the rod to the handle portion of the compound bow to enable the rod to extend rearwardly from the handle portion of the compound bow. A single arm member includes a first end and a second end, with the second end of the single arm member attached to the second end of the rod. The single arm member extends outwardly from the rod and in a plane which includes the bow limbs. A first cable guide slidably receives and separates the first and second cable. The single arm member enables in use simultaneous vertical movement of the first cable guide with the first and second cable during the drawing and return of the bowstring. The first guide is attached to the first end of the single arm member such that in use the first cable and the second cable do not rub against each other thereby decreasing the amount of noise produced by vibrations of the first and the second cables after the bowstring has propelled an arrow.

16 Claims, 4 Drawing Sheets

CABLE VIBRAGUARD

BACKGROUND OF THE INVENTION

1. Description of the Invention

This invention relates to a cable vibration guard for a compound bow and more particularly to a cable vibration guard for use with any bow having a compound configuration.

2. Information Disclosure Statement

In a compound bow apparatus, a single cable is used. The mid-portion of the cable comprises the bowstring or arrow receiving portion of the cable. Whereas the two end portions of the cable each extend over respective pulleys positioned at or proximate the bow tips, across to the opposite limbs where the ends are attached directly or indirectly to the bow limb. One drawback of the compound bow is the noise generated upon releasing the bowstring to propel the arrow. When the bowstring reaches the end of its arrow propelling path, the cables which cross in the center portion of the bow rub against each other to produce a noise or sound which may alert game birds and animals.

In one cable separator disclosed in U.S. Pat. No. 4,596,228 a rod is attached to the handle portion of the bow and extends rearwardly beyond the bowstring. Positioned about the external surface of the rod is a cable guard assembly which positions a cable on either side of the bow. The purpose of the invention is to prevent an interfering contact of the cable strands with an arrow during impelling flight of the arrow from the bow thereby obviating impairment of the true flight of the arrow released from the bow.

In U.S. Pat. No. 4,377,152 a cable guard which is characterized as being readily adjustable to provide about an inch or more of cable deflection or offset is disclosed.

In. U.S. Pat. No. 4,452,222 a cable guard which comprises a rod which extends from the bow handle and beyond the cables when the bow is in a fully drawn position, is disclosed. The rod is based laterally from the bowstring sufficient to void any interference with the bowstring. A cable retaining member is rotatably and slidably mounted on the rod. The cable retaining member includes two bores which are perpendicular to the rod for slidably receiving the cables to hold them in a lateral spaced relationship with the bowstring. A need exists in the prior art to provide a cable guard which does not extend beyond the crossing cables which are positioned between the bowstring and the handle portion of the compound bow.

Therefore, it is an object of this invention to dampen the noise generated by the cables which cross one another in extending between opposite bow limbs upon release of the drawn bowstring.

It is a further object of this invention to provide a cable guard apparatus which does not interfere with the speed at which the arrow leaves the bow apparatus.

It is a further object of this invention to provide a cable guard which separates the cables positioned between the bowstring and the handle portion of the compound bow.

It is a further object of this invention to provide a cable guard which does not protrude beyond the cables positioned between the bowstring and the handle portion of the compound bow.

It is a further object of this invention to provide a cable guard which does not protrude beyond the bowstring of the compound bow.

It is a further object of this invention to provide a cable guard which includes a rod which extends to a position proximate the first and the second cables when the compound bow is in a relaxed position.

It is a further object of this invention to provide a cable guard which includes a rod which extends to a position either to the first and second cables or to a position between the handle portion of the compound bow and the first and the second cables when the compound bow is in a relaxed position thereby enhancing the safety of the bow apparatus in the event the bow handle slips in use from the hand of the archer to provide a barrier comprising the first and the second cables together with an arm member thereby lessening the extent of the intrusion of the second end of the rod toward the body of the archer.

It is a further object of this invention to provide a cable guard which does not absorb energy provided by the bowstring to the arrow.

It is a further object of this invention to provide a cable guard which is economical to produce and maintain.

It is a further object of this invention to provide a cable guard which decreases the noise generated during use so as to not alert or frighten game birds and animals.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For purposes of summarizing the invention, the invention may be incorporated into an apparatus comprising a cable guard for use with a compound bow having a handle portion and a pair of bow limbs extending from the handle portion, together with a first cable, a second cable and a bowstring extending between the bow limbs. The cable guard comprises a rod having a first end and a second end. A mounting means attaches in use the first end of the rod to the handle portion of the compound bow such that the rod extends rearwardly from the handle portion of the compound bow and toward the bowstring. An arm member is disposed at the second end of the rod. The arm member preferably extends bidirectionally outwardly from the rod and in a plane which includes the bow limbs. The arm member includes a first end and a second end. A first cable guide means and a second cable guide means slidably receives and separates the first and second cable . The first cable guide means and the second cable guide means are positioned at the first end and the second end of the arm member, respectively. The arm member includes means which enables in use a simultaneous vertical movement of the first and the second cable guide means with the first and second cable during the drawing and release of the bowstring. The means for enabling in use the first and the second cable guide means to move simultaneously along with the first and second cable during the drawing of the bowstring ensures the separation of the first and second cables as the cables are moved rearwardly from the handle portion during the drawing of the bowstring and as the cables are moved toward the handle during the propelling of an arrow upon release of the bowstring such that in use the first cable and the second cable do not rub against each other thereby decreasing the amount of noise produced by vibrations of the first and the second cables immediately after the bowstring has propelled an arrow.

Preferably, the rod extends to a position proximate the first and the second cables when the compound bow is in a relaxed position. Most preferably, the rod extends only to a position between the handle and the first and the second cables or to the first and second cables when the compound bow is in a relaxed position. Thus, the length of the rod is about 6–12 inches as measured from the handle to the first and second cables. If the second end of the rod extends beyond the first and second cables when the bow is in a relaxed position, the benefit of protecting the archer is decreased in the event the handle slips, in use, from the archer's grip causing the second end of the rod to be propelled toward the archer and possibly injuring the archer.

The arm member includes means for enabling in use a simultaneous vertical movement of the first and the second cable guide means with the first and second cable during the drawing and release of the bowstring. Such means include the arm member being resilient and biased toward a rest position after being pulled out of position during the drawing of the bowstring such that upon release of the bowstring the first and second cables are compelled to stop vibrating by the arm member returning to the rest position thereby enhancing the decrease in the amount of noise produced by the vibrating of the first and the second cable after the bowstring has propelled an arrow. Preferably, such means include the arm member comprising a leaf spring with a first end, a mid-portion and a second end. The first cable guide means and the second cable guide means are positioned at the first end and the second end of the leaf spring, respectively. The mid-portion of the leaf spring is securely attached to the second end of the rod such that in use the leaf spring returns to a rest position after being pulled out of position during the drawing of the bowstring such that upon release of the bowstring each of the first and second cables is compelled to stop vibrating by the leaf spring returning to the rest position. Preferably, the first and second cable guide means are pivotally attached at the first end and second end of leaf spring, respectively, to decrease drag between the first and second cable guide means and the first and the second cables sliding therethrough. Upon drawing the bowstring energy is stored in the resilient and biased (toward a rest position) arm member such that upon release of the bowstring, the first and second cable guides are forced toward the handle portion of the bow by the biased arm member thereby not dissipating energy otherwise used to propel the arrow.

The arm member includes means for enabling in use a simultaneous vertical movement of the first and the second cable guide means with the first and second cable during the drawing and release of the bowstring. In another embodiment of the incention, such means include the arm member comprising a first bar and a second bar with each the first and second bar having a first end and a second end. The first end of the first bar and second bar is pivotally attached at the second end of the rod. The first and the second cable guide means is pivotally attached at each the second end of each first and second bar. Preferably, the first and second cable guide means comprise a first and a second guide member, respectively, with each the guide member having a first and a second opening formed therein to slidably receive and separate the first and the second cable as the first and second cables travel through the first and second openings, respectively, of each of the first and second cable guides during the drawing and release of the bowstring, respectively. The first and the second guide members are, preferably, pivotally attached at each the second end of each the bar to decrease drag between the first and second cable guide members and the first and the second cables sliding therethrough.

Preferably, the first and second cable guides each comprise a guide member having a first opening and a second opening formed therein to slidably receive and separate the first and the second cable as the first and second cables travel through the first and second openings, respectively, of each of the first and second cable guides during the drawing and release of the bowstring, respectively. Preferably, the guide members are formed of a self-lubricating material. The self-lubricating material enables substantially frictionless movement between the guide members and the cables traveling through the openings formed therein. The self-lubricating materials include nylon, Dacron, Teflon (tetra-fluoroethylene resin).

In a further embodiment of the invention, the rod is offset such that the first and second cable guide means position the first and the second cables laterally away from the working zone of the bowstring and of the arrow being propelled by the bowstring thereby preventing a trajectory interfering contact of the arrow by the first and the second cables. The offset rod ensures true flight of the arrow released by the bow apparatus.

In a preferred embodiment of the invention the cable guard for use with a compound bow having a handle portion and a pair of bow limbs together with a first cable, a second cable and a bowstring, comprises a rod having a first end and a second end. A mounting means attaches in use the first end of the rod to the handle portion of the compound bow such that the rod extends rearwardly from the handle portion of the compound bow. An arm member is disposed at the second end of the rod. The arm member extends bidirectionally and outwardly from the rod and in a plane which includes the bow limbs. The arm member includes a first end and a second end. A first and a second cable guide means slidably receives and separates the first and second cable. The arm member defines a leaf spring which enables in use simultaneous vertical movement of the first and the second cable guide means with the first and second cable during the drawing and release of the bowstring. The leaf spring is biased toward a rest position after being pulled out of position during the drawing of the bowstring such that upon release of the bowstring the first and second cables are compelled to stop vibrating by the leaf spring returning to the rest position thereby decreasing the amount of vibration noise produced by the vibrating of the first and the second cable after the bowstring has propelled an arrow. The leaf spring includes a first end, a mid-portion and a second end. The first cable guide means and the second cable guide means are positioned at the first end and the second end of the leaf spring, respectively. The mid-portion of the leaf spring is securely attached to the second end of the rod. The first and second cable guide means are pivotally attached at the first end and second end of leaf spring, respectively, to decrease friction or drag between the cable guide means and the first and the second cables extending therethrough. Preferably, the first and second cable guide each comprise a guide member having a first and a second opening formed therethrough to slideably receive and separate the first and the second cable therethrough, respectively.

In a preferred embodiment of the invention the cable guard for use with a compound bow having a handle portion and a pair of bow limbs together with a first cable, a second cable and a bowstring, comprises a rod having a first end and a second end. A mounting means attaches in use the first end of the rod to the handle portion of the compound bow such that the rod extends rearwardly from the handle portion of the compound bow. An arm member is disposed at the second end of the rod. The arm member extends bidirectionally and outwardly from the rod and in a plane which includes the bow limbs. The arm member includes a first end and a second end. A first and a second cable guide means slidably receives and separates the first and second cable. The arm member comprises a first bar and a second bar with each first and second bar having a first end and a second end. The first end of each first bar and second bar is pivotally attached at the second end of the rod for enabling in use simultaneous vertical movement of the first and the second cable guide means with the first and second cable during the drawing and release of the bowstring. The first and second cable guide means is pivotally attached at each second end of each first and second bar such that in use the first cable and the second cable do not rub against each other thereby decreasing the amount of noise produced by vibrations of the first and the second cables especially immediately after the bowstring has propelled an arrow. Preferably, the means of the arm member for enabling in use simultaneous vertical movement of the first and the second cable guide means with the first and second cable during the drawing of the bow includes the arm member comprises a first bar and a second bar with each the first bar and second bar having a first end and a second end. The first end of the first bar and the second bar is each pivotally attached at the second end of the rod. Preferably, the first and second cable guide comprise a first and a second guide member, respectively, with each first and second member having a first and a second opening formed therein to receive the first and the second cable therethrough, respectively. The first and second guide member are each pivotally attached at each the second end of each the bar.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
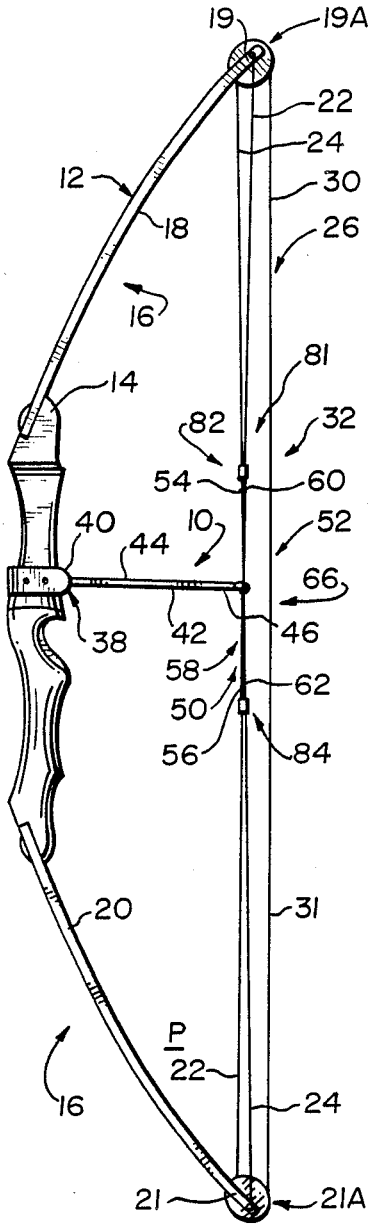
FIG. 1 is a side view illustrating the apparatus of the invention attached to a compound bow in a rest position.

FIG. 1 is a side view illustrating the apparatus of the invention 10. The apparatus of the invention 10 is used with a conventional compound bow 12 having a bow handle 14 and a pair of bow limbs 16. The first bow limb 18 and the second bow limb 20 are oppositely positioned in bow handle 14. A bow string 30 spans between the first bow tip 19 and the second bow tip 21. The bow string 30 then continues and extends over the pulleys 19A, 21A positioned at or proximate each of the bow tips 19, 21 and then the two ends of bow string 30, designated first cable end 22 and second cable end 24, cross to the opposite limb at which point they are attached to define a compound bow 12. The apparatus of the invention 10 includes a mounting means 38. The mounting means 38 includes an attachment plate 40 which has a series of holes formed therein for receiving screws or bolts by means of which the attachment plate 40 is secured to the bow handle 14. A rod 42 having a first end 44 and a second end 46 is disclosed. The mounting means 38 firmly attaches the first end 44 of the rod 42 to the handle portion 14 of the compound bow 12 such that the rod 42 extends rearwardly from the handle portion 14 of the compound bow 12. Thus, the first end 44 of rod 42 is positioned proximate the handle portion 14 of the bow 12. The second end 46 of rod 42 extends rearwardly toward the cables 26. As illustrated, the second end 46 of rod 42 terminates at the first 22 and second 24 cables when the bow is in a relaxed position 32. An arm member 52 having a first end 54 and a second end 56 is disposed at the second end 46 of rod 42. The arm member 52 extends outwardly from rod 42 and within a plane "P"which includes the bow limbs 16. The plane "P" of the bow limbs 16 is the plane of the paper of FIG. 1. A first cable guide means 82 is positioned at the first end 54 of arm member 52. The first cable guide means 82 slidably receives and separates the first cable 22 and second cable 24. The arm member 52 includes a means for enabling in use the first cable guide means 82 which is positioned at the first end 54 of arm member 52 to move vertically within the plane of the bow limbs "P". This permits simultaneous movement of the first cable guide means 82 with the first and second cable such that the first 22 and second 24 cables are slidably received and separated during the drawing and release of the bowstring 30 thereby ensuring that the first cable 22 and second cable 24 do not rub against each other thereby decreasing the amount of noise produced by the vibrations of the first 22 and second 24 cables immediately after the bowstring 30 has propelled an arrow.

The means 50 of arm member 52 for enabling a cable guide means 81 to move vertically within the plane "P" of the bow limbs 16 is a leaf spring 58. The leaf spring includes a first end 60, a mid-portion 64 and a second end 62. As illustrated at FIG. 1 the leaf spring 58 is in a rest position 66. Positioned at the first end 60 of leaf spring 58 is a first cable guide means 82. Positioned at the second end 62 leaf spring 58 is a second cable guide means 84.

Figure 2:
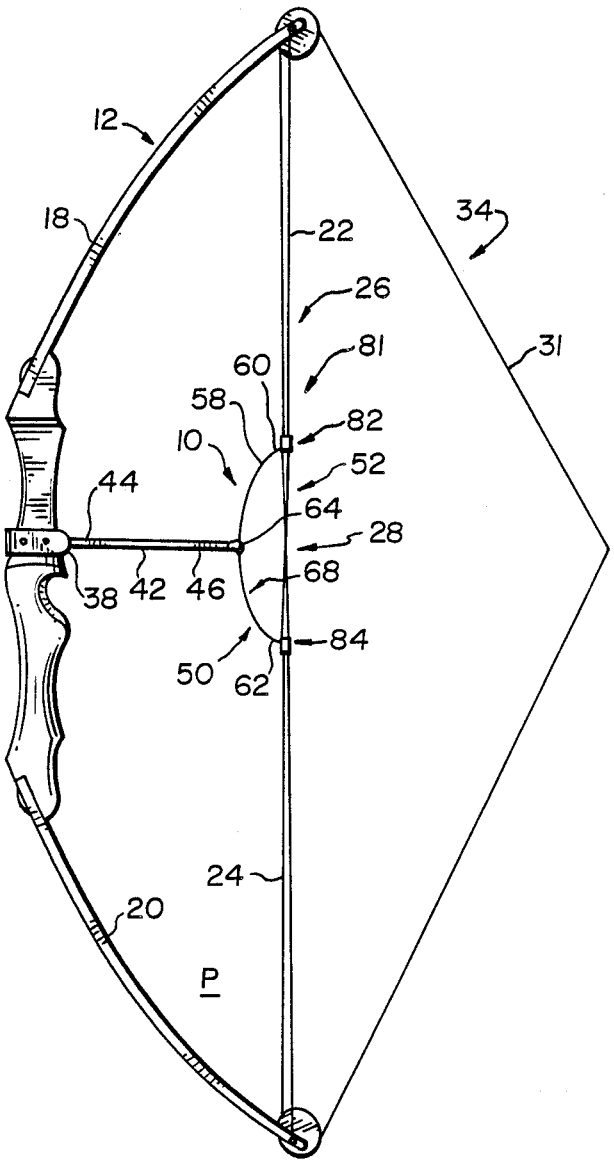
FIG. 2 is a side view illustrating the apparatus of the invention attached to a compound bow in a drawn position.

FIG. 2 illustrates a bow 12 in a drawn or tensioned position 34. Whereas FIG. 1 illustrates the bow 12 in a relaxed position 32. In the drawn position 34, the leaf spring 58 is in a working or tensioned position 68. The first cable guide means 82 and the second cable guide means 84 positioned at the first end 60 and second end 62 of spring leaf 58, respectively, have moved vertically in the plane of the bow limbs "P" as upon evident in comparing FIG. 1 and FIG. 2.

Figure 3:
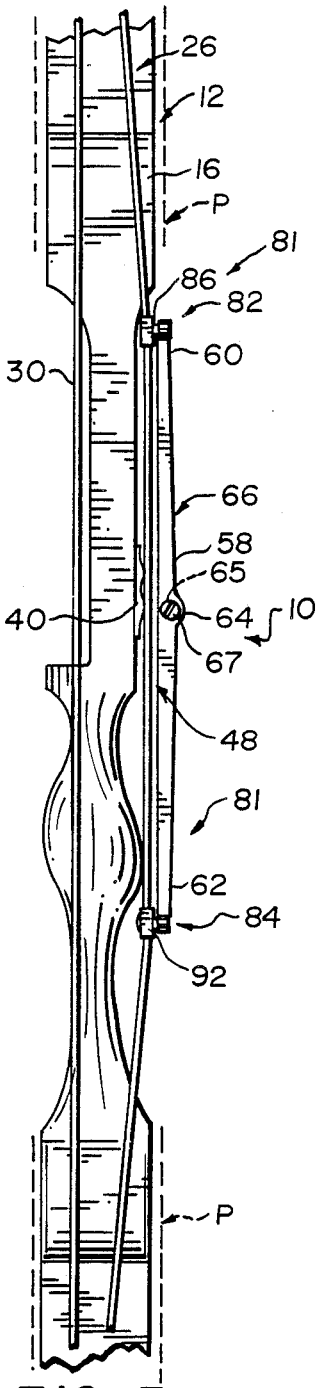
FIG. 3 is a partial rear view of FIG. 1.

FIG. 3 is a partial rear view of FIG. 1 and provides greater detail of leaf spring 58. The leaf spring 58 is attached to the second end 46 of rod 42 by means of a hole 65 formed in the mid-portion 64 of leaf spring 58. A hole 65 is formed in the mid-portion 64 of leaf spring 58 to receive a mounting screw or bolt 67 to firmly attach the leaf spring 58 to the second end 46 of rod 42. A first cable guide means 82 is positioned at the first end 60 of leaf spring 58. A second cable guide means 84 is positioned at the second end 62 of leaf spring 58.

Figure 4:
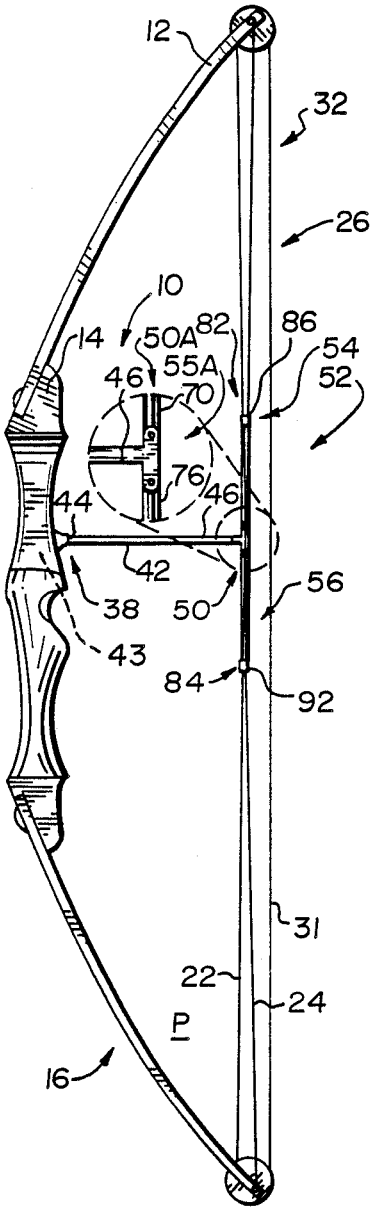
FIG. 4 is a side view illustrating another embodiment of the invention attached to a compound bow in a drawn position.

FIG. 4 is a plan view of bow 12 in a relaxed position 32 illustrating another embodiment of the invention. The means 50 of arm member 52 for enabling cable guide means 82, 84 to move vertically within the plane "P" of bow limbs 16 includes a first bar 70 and a second bar 76. The pivotal attachment 50A of the first 70 and the second 76 bar at the second end 46 of rod 42 is illustrated in the exploded portion of FIGS. 4 and 5. The first bar 70 includes a first end 72 and a second end 74. The first end 72 of the first bar 70 is pivotally attached 71 to the second end 46 of rod 42. The first end 78 of the second bar 76 is likewise pivotally attached 77 to the second end 46 of rod 42. Positioned at the first end 72 of the first bar 70 is a first cable guide means 82. Positioned at the first end 78 of the second bar 76 is a second cable guide means 84.

Figure 5:
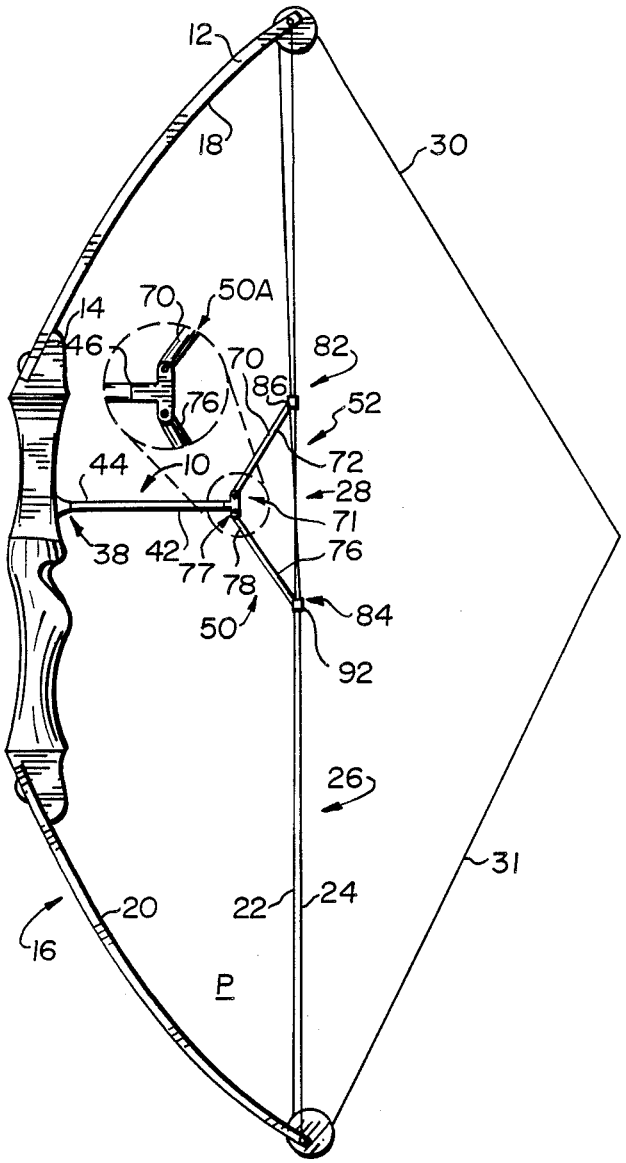
FIG. 5 is a side view illustrating another embodiment of the invention attached to a compound bow in a rest position.

FIG. 5 is a plan view of the bow of FIG. 4 in a tensioned or drawn 34 position. The crossing 28 of the first 22 and second 24 cables is clearly illustrated. The first cable guide means 82 and the second cable guide means 84 slidably receive and separate the first cable 22 and the second cable 24. Thus, when the bowstring 30 is released, the first cable 22 and second cable 24 do not frictionally engage or rub against one another to generate vibrations or noise which can be detected by game birds or animals. Preferably, the first cable guide means 82 is a first guide member 86. A description of the first guide member 86 describes the second guide member 92. Thus, the first guide member 86 includes a first opening 88 and a second opening 90. In a like construction, the second guide member 92 includes a first opening 94 and a second opening 96. The first 82 and second 84 cable guide means each comprise a guide member 96. The first 82 and second 84 cable guide means each comprise a guide member 86, 92 each having a first 88, 94 and second 90, 96 opening formed therethrough to receive the second cable 24 and first cable 22 therethrough, respectively. Such construction in cooperation with the leaf spring 58 compels the cables to stop vibrating upon the return of the leaf spring 58 to its rest position 66. Where the means 50 of arm member 52 for enabling the cable guide means to travel or move vertically with the plane "P" of the bow limbs 16 is a first 70 and second 76 bar with each bar 70, 76 having a first end 72, 78, respectively, attached to the second end 46 of rod 42, preferably, the first ends 72, 78 of the first and second bar 70, 76 are pivotally attached 71, 77 to the second end 46 of rod 42. The exploded view of FIG. 5 illustrates in greater detail the means 50 of arm member 52 for enabling the cable guide means 82,84 to travel or move vertically within the plane "P" of the bow limbs 16 where the means 50 is the pivotal attachment of the first and second bars 70,76 to the second end 46 of rod 42.

Figure 6:
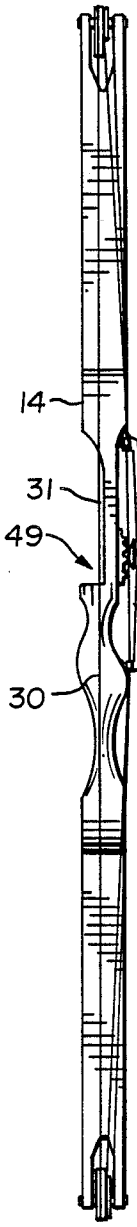
FIG. 6 is a rear view of FIG. 4.

FIG. 6 illustrates the attachment of apparatus 10 to the handle portion 14 of the bow 12. The rod 42 is offset 48 from the handle 14 of the' bow 12 to laterally move the first 22 and second 24 cables away from the working path 49 of the arrow.

Figure 7:
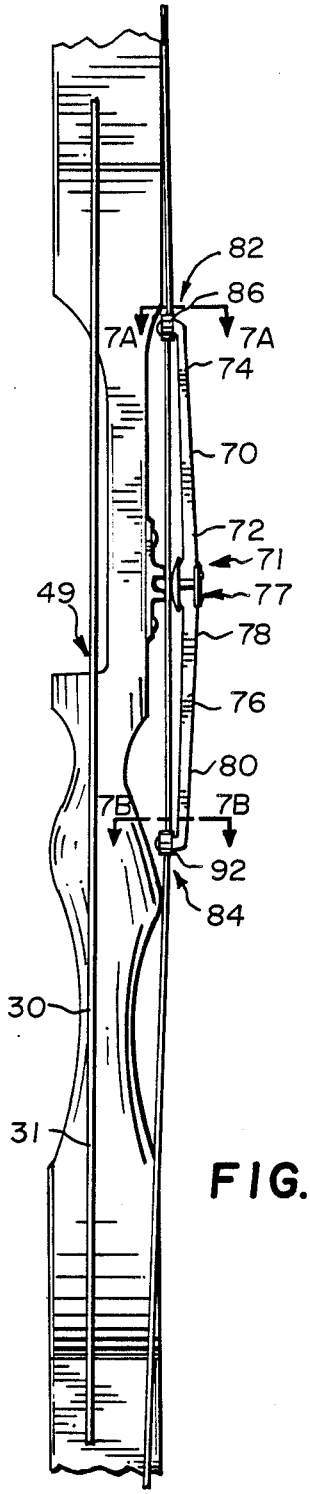
FIG. 7 is an enlarged view of FIG. 6.

FIG. 7 illustrates in greater detail the lateral movement of the first 22 and second 24 cables from the working path 49 of the arrow. The working path 49 is described as the line of flight of the arrow shaft and/or the arrow fletching. The first guide member 86 and second guide member 92 are pivotally attached 87, 93 to each second end 74,80 of the first 70 and second 76 bars, respectively.

The guide members 86, 92 includes a first 88, 94 opening and a second 90, 96 opening formed therethrough to permit the first 22 and second 24 cables to slidably and separately move through the openings during the drawings and release of the bowstring.

Figure 8:
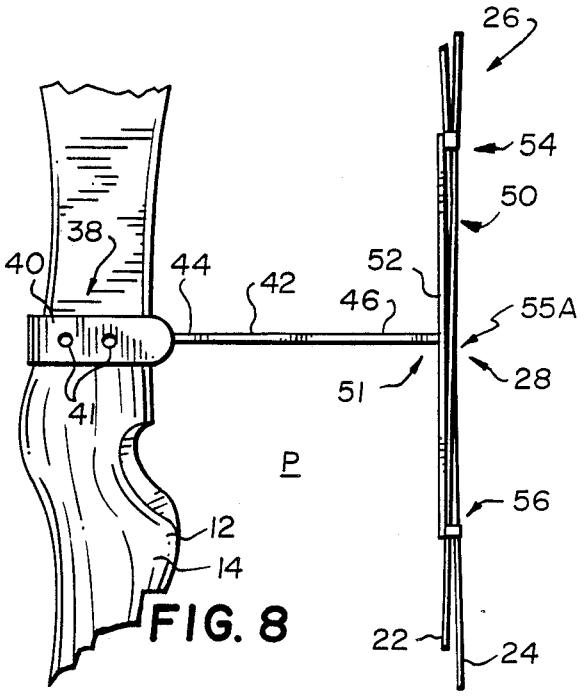
FIG. 8 is an enlarged view of the apparatus of FIG. 1 absent the compound bow.
Figure 7B:
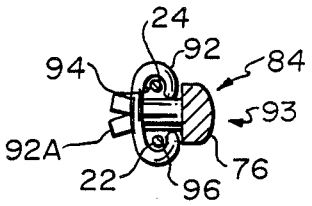
FIG. 7B is a partial section taken along line 7B—7B of FIG. 7.
Figure 7A:
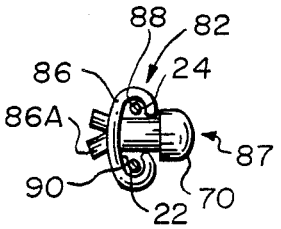
FIG. 7A is a partial section taken along line 7A—7A of FIG. 7.

FIGS. 7A and 7B illustrate in greater detail the first 82 and second 84 cable guide means, respectively. The first guide member 86 and the second guide member 92 are pivotally attached 87,93 to first post 86A and second post 92A, respectively. The first post 86A and second post 92A are securely attached to the second end 74 of the first bar 70 and the second end 80 of the second bar 76, respectively. Other methods of attachment are known to those skilled in the art. FIG. 8 is an enlarged view of the apparatus of the invention 10 attached to cables 26. The attachment means 38 includes an attachment bracket 40 having countersunk mount holes 41 through which a threaded bolt (not shown) or the like engages the handle 14 of bow 12 (not shown). The attachment bracket 40 secures the first end 44 of rod 42. Rod 42 extends from the handle portion 14 of the bow 12 to the cables 26. Positioned at the second end 46 of rod 42 is arm member 52. The mid-portion 55A of the arm member 52 is attached to the second end 46 of rod 42.

The arm member 52 including means 50 for enabling in use the first 82 and the second 84 cable guide means positioned at the first end 54 and the second end 56 of the arm member 52, respectively, to move vertically within the plane "P" of the bow limbs to enable simultaneous movement with the first and second cables such that the first and the second cables are slidably received and separated during the drawing and release of the bowstring such that the first cable and the second cable do not rub against each other thereby decreasing the amount of noise produced by vibrations of the first and the second cables immediately after the bowstring has propelled an arrow. Such means include leaf spring 58 and pivot attachment of the first ends 72,78 of the first 70 and second 76 bars to the second end 46 of rod 42.

Figure 9:
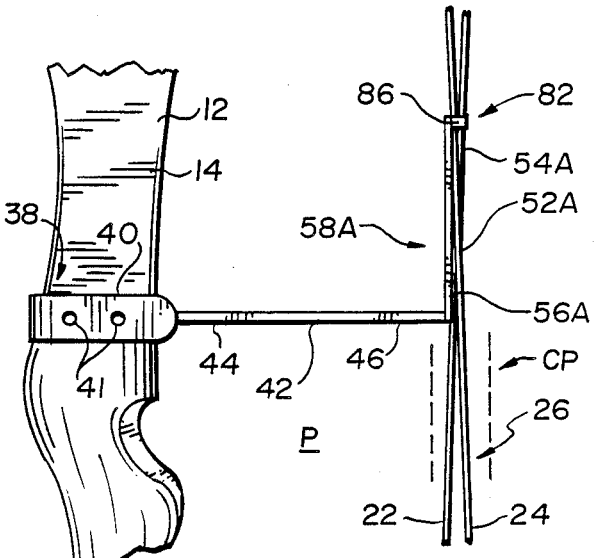
FIG. 9 is an enlarged view of another embodiment of the invention absent the compound bow.

FIG. 9 illustrates the apparatus of the invention 10 absent the elements of bow 12 except for cable 26. The attachment means 38 includes an attachment bracket 40 as described above. The first end 44 of rod 42 is securely attached to the attachment bracket 40. The second end 46 of rod 42 extends proximate a plan CP of cables 26. The plane CP of cables 26 is perpendicular to the plane P of the bow limbs. The single arm member 52A includes a first end 54A and a second end 56A. The second end 56A of the single arm member 52A is disposed at the second end 46 of rod 42. A first cable guide means 82 is positioned at the first end 54A of single arm member 52A. First cable guide means 82 includes a first cable guide member 80 which slidably receives and separates cables 26.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of contruction and the combination and arrangement of parts may be resorted to without departing from the spirit and scope of the invention.

What is claimed is:

1. A cable guard for use with a compound bow having a handle portion and a pair of opposite bow limbs together with a first cable, a second cable which cross one another in extending between opposite bow limbs and a bowstring , comprising:

a rod having a first end and a second end;

mounting means for attaching in use said first end of said rod to the handle portion of the compound bow such that said rod extends rearwardly from said handle portion of the compound bow;

a single arm member having a first end and a second end with said second end of said single arm member being disposed at said second end of said rod;

said single arm member extending outwardly from said rod and in a plane which includes the bow limbs;

a first cable guide means for slidably receiving and separating the first and second cable; and said single arm member including means for enabling in use said first cable guide means positioned at said first end of said arm member to move vertically within the plane of the bow limbs to permit simultaneous movement with the first and second cable such that said first and said second cables are slidably received and separated during the drawing and release of the bowstring thereby ensuring that the first cable and the second cable do not rub against each other thereby decreasing the amount of noise produced by vibrations of the first and the second cables especially immediately after the bowstring has propelled an arrow.

2. The cable guard of claim 1 wherein means for enabling in use said first cable guide means to move vertically within the plane of the bow limbs to permit simultaneous vertical movement of said first cable guide means with the first and second cable during the drawing and release of the bowstring comprises said second end said of said single arm member being pivotally attached at said second end of said rod.

3. A cable guard for use with a compound bow having a handle portion and a pair of bow limbs together with a first cable, a second cable and a bowstring, comprising:

a rod having a first end and a second end;

mounting means for attaching in use said first end of said rod to the handle portion of the compound bow such that said rod extends rearwardly from said handle portion of the compound bow;

an arm member disposed at said second end of said rod;

said arm member extending bidirectionally and outwardly from said rod and in a plane which includes the bow limbs;

said arm member including a first end and a second end;

a first and a second cable guide means for slidably receiving and separating the first and second cable;

said arm member includes means for enabling in use simultaneous vertical movement of said first and said second cable guide means with the first and second cable during the drawing of the bow;

said arm member including means for enabling in use said first and said second cable guide means positioned at said first end and said second end of said arm member, respectively, to move vertically within the plane of the bow limbs to enable simultaneous movement with the first and second cable such that said first and said second cables are slidably received and separated during the drawing and release of the bowstring such that the first cable and the second cable do not rub against each other thereby decreasing the amount of noise produced by vibrations of the first and the second cables immediately after the bowstring has propelled an arrow.

4. The cable guard of claim 3 wherein said rod extends to a position proximate the first and the second cables when the compound bow is in a relaxed position.

5. The cable guard of claim 4 wherein said rod extends from the handle portion of the bow to the first and the second cables when the compound bow is in a relaxed position.

6. The cable guard of claim 4 wherein said means of said arm member for enabling in use simulataneous vertical movement of said first and said second cable guide means with the first and second cable during the drawing of the bow includes said arm member being biased toward a rest position after being pulled out of position during the drawing of the bowstring such that upon release of the bowstring the first and second cables are compelled to stop vibrating by said arm member returning to said rest position thereby enhancing the decrease in the amount of noise produced by the vibrating of the first and the second cable after the bowstring has propelled an arrow.

7. The cable guard of claim 6 wherein said arm member is a leaf spring with a first end, a mid-portion and a second end;

said first cable guide means and said second cable guide means being positioned at said first end and said second end of said leaf spring, respectively, said mid portion of said leaf spring being securely attached to said second end of said rod such that in use said leaf spring returns to a rest position after being pulled out of position during the drawing of the bowstring such that upon release of the bowstring each first and second cables is compelled to stop vibrating by said leaf spring returning to said rest position.

8. The cable guard of claim 7 wherein said first and second cable guide means are pivotally attached at said first end and second end of leaf spring, respectively, to decrease drag between said cable guide means and said first and said second cables extending therethrough.

9. The cable guard of claim 8 wherein said first and second cable guide each comprise a guide member having a first and a second opening formed therein to receive said first and said second cable therethrough, respectively.

10. The cable guard of claim 4 wherein said rod is offset such that the first and second cable guide means position the first and the second cables laterally away from the path of the arrow being propelled by the bowstring thereby preventing a trajectory interfering contact of said arrow by said first and said second cables.

11. The cable guard of claim 4 wherein said means of said arm member for enabling in use simultaneous vertical movement of said first and said second cable guide means with the first and second cable during the drawing of the bow includes said arm member comprising a first bar and a second bar with each said first and second bar having a first end and a second end;

said first end of each said first bar and second bar being pivotally attached at said second end of said rod; and said first and said second cable guide means being pivotally attached at each said second end of each said bar.

12. The cable guard of claim 4 wherein said means of said arm member for enabling in use simultaneous vertical movement of said first and said second cable guide means with the first and second cable during the drawing of the bow includes said arm member comprising a first bar and a second bar with each said first bar and second bar having a first end and a second end;

said first end of each said frist bar and second bar being pivotally attached at said second end of said rod;

wherein said first and second cable guide comprise a first and a second guide member, respectively, with each said guide member having a first and a second opening formed therethrough to receive said first and said second cable therethrough, respectively; and said first and said second guide member being pivotally attached at each said second end of each said bar.

13. A cable guard for use with a compound bow having a handle portoin and a pair of bow limbs together with a first cable, a second cable and a bowstring, comprising:

a rod having a first end and a second end;

mounting means for attaching in use said first end of said rod to the handle portion of the compound bow such that said rod extends rearwardly from said handle portion of the compound bow;

an arm member disposed at said second end of said rod;

said arm member extending bidirectionally and outwardly from said rod and in a plane which includes the bow limbs;

said arm member including a first end and a second end;

a first and a second cable guide means for slidably receiving and separating the first and second cable;

said arm member defining a leaf spring for enabling in use simultaneous vertical movement of said first and said second cable guide means with the first and second cable during the drawing and release of the bowstring;

said leaf spring being biased toward a rest position after being pulled out of position during the drawing of the bowstring such that upon release of the bowstring the first and second cables are compelled to stop vibrating by said leaf spring returning to said rest position thereby decreasing the amount of vibration noise produced by the vibrating of the first and the second cable after the bowstring has propelled an arrow;

said leaf spring including a first end, a mid-portion and a second end;

said first cable guide means and said second cable guide means being positioned at said first end and said second end of said leaf spring, respectively.

said mid-portion of said leaf spring being securely attached to said second end of said rod such that in use said leaf spring returns to a rest position after being pulled out of position during the drawing of the bowstring such that upon release of the bowstring each first and second cables is compelled to stop vibrating by said leaf spring returning to said rest position; and said first and second cable guide means are pivotally attached at said first end and second end of leaf spring, respectively, to decrease drag between said cable guide means and said first and said second cables extending therethrough.

14. The cable guard of claim 13 wherein said first and second cable guide each comprise a guide member having a first and a second opening formed therethrough, to receive said first and said second cable therethrough, respectively.

15. A cable guard for use with a compound bow having a handle portion and a pair of bow limbs together with a first cable, a second cable and a bowstring, comprising:

a rod having a first end and a second end;

mounting means for attaching in use said first end of said rod to the handle portion of the compound bow such that said rod extends rearwardly from said handle portion of the compound bow;

an arm member disposed at said second end of said rod;

said arm member extending bidirectionally and outwardly from said rod and in a plane which includes the bow limbs;

said arm member including a first end and a second end;

a first and a second cable guide means for slidably receiving and separating the first and second cable;

said arm member comprising a first bar and a second bar with each said first and s econd bar having a first end and a second end;

said first end of each said first bar and second bar being pivotally attached at said second end of said rod for enabling in use simultaneous vertical movement of said first and said second cable guide means with the first and second cable during the drawing and release of the bowstring; and said first and said second cable guide means being pivotally attached at each said second end of each said bar such that in use the first cable and the second cable do not rub against each other thereby decreasing the amount of noise produced by vibrations of the first and the second cables especially immediately after the bowstring has propelled an arrow.

16. The cable guard of claim 15 wherein said means of said arm member for enabling in use simultaneous vertical movement of said first and said second cable guide means with the first and second cable during the drawing of the bow includes said arm member comprising a first bar and a second bar with each said first bar and second bar having a first end and a second end;

said first end of each said first bar and second bar being pivotally attached at said second end of said rod;

wherein said first and second cable guide comprise a first and a second guide member, respectively, with each said guide member having a first and a second opening formed therein to receive said first and said second cable therethrough, respectively; and said first and said second guide member being pivotally attached at each said second end of each said bar.

* * * * *

UNITED STATES PATENT AND TRADEMARK OFFICE

CERTIFICATE OF CORRECTION

PATENT NO. : 4,834,061

DATED : May 30, 1989

INVENTOR(S) : Jesse R. Chattin

It is certified that error appears in the above-identified patent and that said Letters Patent is hereby corrected as shown below:

In the Specification

Column 3, line 68, delete "incention" and insert therefor --invention--.

Column 9, line 24, delete "plan" and insert therefor --plane--.

In the Claims

Claim 12, line 8, delete "frist" and insert therefor --first--.

Signed and Sealed this

Fifteenth Day of May, 1990

*Attest:*

HARRY F. MANBECK, JR.

*Attesting Officer*

*Commissioner of Patents and Trademarks*